US007192048B2

(12) United States Patent
Restani

(10) Patent No.: US 7,192,048 B2
(45) Date of Patent: Mar. 20, 2007

(54) ALPINE SKI

(75) Inventor: Eric Restani, Voiron (FR)

(73) Assignee: Skis Rossignol S.A., Voiron (FR)

( * ) Notice: Subject to any disclaimer, the term of this patent is extended or adjusted under 35 U.S.C. 154(b) by 54 days.

(21) Appl. No.: 10/206,510

(22) Filed: Jul. 26, 2002

(65) Prior Publication Data

US 2003/0020257 A1 Jan. 30, 2003

(30) Foreign Application Priority Data

Jul. 27, 2001 (FR) ..... 01 10089

(51) Int. Cl.
*A63C 5/07* (2006.01)

(52) U.S. Cl. ..... 280/607; 280/609

(58) Field of Classification Search ..... 280/601, 280/602, 607, 609, 610; 411/68
See application file for complete search history.

(56) References Cited

U.S. PATENT DOCUMENTS

| | | | | |
|---|---|---|---|---|
| 1,998,702 | A * | 4/1935 | Boline | 280/609 |
| 4,300,786 | A | 11/1981 | Alley | 280/602 |
| 4,804,200 | A * | 2/1989 | Kuchler | 280/602 |
| 5,199,734 | A * | 4/1993 | Mayr | 280/602 |
| 5,292,147 | A * | 3/1994 | Bejean | 280/602 |
| 5,303,948 | A * | 4/1994 | Le Masson et al. | 280/607 |
| 5,346,244 | A | 9/1994 | Le Masson | 280/607 |
| 5,538,271 | A * | 7/1996 | Abondance | 280/602 |
| 5,785,342 | A * | 7/1998 | Bronson | 280/602 |
| 5,820,154 | A * | 10/1998 | Howe | 280/602 |
| 5,865,459 | A * | 2/1999 | Piegay | 280/602 |
| 5,879,019 | A | 3/1999 | Mantel | 280/620 |
| 6,237,932 | B1 * | 5/2001 | Zanco et al. | 280/602 |

FOREIGN PATENT DOCUMENTS

| | | | |
|---|---|---|---|
| DE | 3619118 | A1 * | 12/1987 |
| DE | 3933717 | A1 * | 4/1990 |
| DE | 4020212 | A1 * | 1/1991 |
| DE | 4205846 | | 10/1993 |
| DE | 19614184 | | 10/1997 |
| FR | 2718650 | | 10/1995 |

* cited by examiner

*Primary Examiner*—Frank Vanaman
(74) *Attorney, Agent, or Firm*—Heslin Rothenberg Farley & Mesiti P.C.; Victor A. Cardona, Esq.

(57) ABSTRACT

Ski (1) including at least one zone (5), for raising the binding, formed by a thickening of the structure of the ski, forming a protuberance in the region of the underfoot zone (2), which includes an insert (12) arranged over at least a fraction of the length of each of its lateral faces (11), said insert (12) being located between the upper face (6) of the raising zone (5) and the edges (9), the outer face (14) of this insert (12) being flush on the lateral face (11) of the ski.

6 Claims, 4 Drawing Sheets

Fig. 2
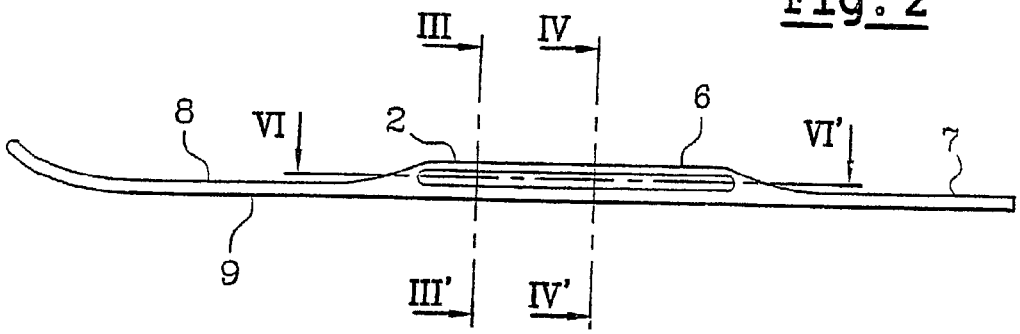
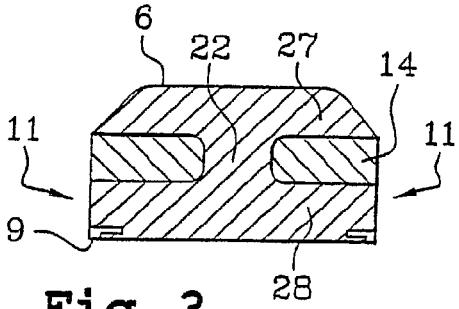
Fig. 3
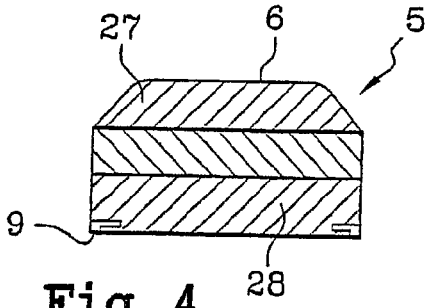
Fig. 4
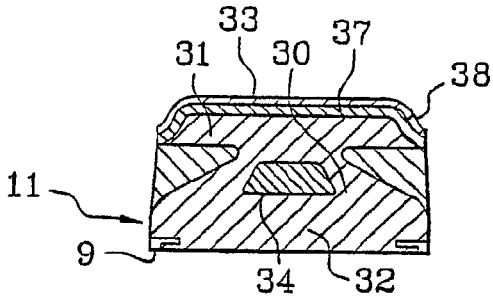
Fig. 5
Fig. 6
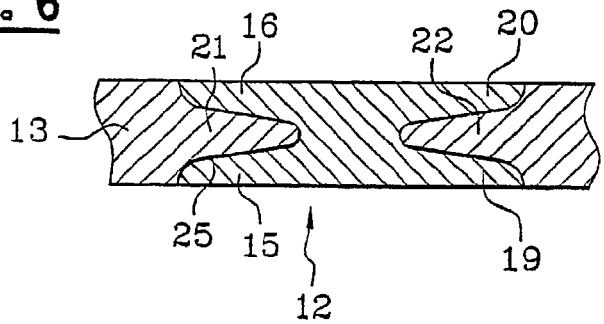

ALPINE SKI

This application claims priority from French patent application 01 10089, filed on Jul. 27, 2001, the entirety of which is incorporated herein by reference.

TECHNICAL FIELD

The invention relates to the field of gliding sports, and more precisely to an alpine ski. More particularly, it relates to a ski that includes a zone, for raising the binding, formed by a thickening of the actual structure of the ski. The invention makes it possible to optimize the mechanical properties of a ski possessing such a structure. The invention also relates to a process for manufacturing such skis.

PRIOR ART

Generally speaking, the upper face of the ski is equipped, in the underfoot zone, with a safety binding consisting of a front stop and a heelpiece. For various reasons, and particularly for facilitating the rocking of the ski from one edge to the other, attempts are made to raise the binding elements relative to the sole of the ski. This raising may be obtained in different ways and, for example, by virtue of the use of a raising platform screwed, or more generally secured, to the upper face of the board. Very many types of platform have already been proposed, such as, in particular, that described in document U.S. Pat. No. 5,879,019.

It has also been proposed to raise the binding not by using an additional element attached to the board but, on the contrary, by configuring the structure of the board such that it has a thickening that itself forms the raising zone. Thus, a description has been given in the document FR 2 718 650 of a ski of which the structure includes, in the region of the underfoot zone, an additional element raising the upper face of the ski relative to the tip and heel zones. This raising forms a raising zone on which the front stop and heelpiece are fitted. Another example of a raising zone produced by virtue of a particular configuration of the actual structure of the board is described in document FR 2 686 520, corresponding to document U.S. Pat. No. 5,346,244.

It is understood that the influence of this raising zone, formed by the structure, on the mechanical properties of the board is significant and, in particular, generates significant stiffening of the underfoot zone. One objective of the invention is to modulate this influence in order to obtain a ski whose dynamic behavior can be optimized.

SUMMARY OF THE INVENTION

The invention thus relates to an alpine ski that includes at least one zone, for raising the binding, formed by a thickening of the structure of the ski, forming a protuberance in the region of the underfoot zone. The ski may include a single raising zone, which receives the two elements of the binding. This raising zone may also be divided into two parts, a first part receiving the front stop and the other part receiving the heelpiece. In certain cases in point, only the front stop or even the heelpiece may be fitted onto a raising zone.

According to the invention, this ski is characterized in that it includes an insert arranged over at least a portion of the length of each of its lateral faces. This insert is located between the upper face of the raising zone and the edges, and its outer face is flush on the lateral face of the ski.

Thus, in the region of the raising zone, on its lateral flanks, the ski includes elongate pieces that may extend over all or part of the length of the raising zone. These pieces may be located in the raising zone itself, i.e. above the level the ski would have if it did not include the raising zone. These inserts may also be located below this level, above the edges. The presence of these inserts and, in particular, their dimensions and the material used influence the overall stiffness of the structure, particularly in the region of the underfoot zone.

Thus, in a first embodiment, the inserts may be formed by elements made from a material that is less rigid than the materials that form the core of the ski in the region of the raising zone, so as to confer damping properties on the ski. The behavior of such a ski may thus be brought closer to that of a conventional ski equipped with a platform attached to its upper face, since the inserts have a compression capacity that allows slight movements of the upper part of the raising zone relative to the rest of the ski. This ski, however, retains the advantages of a raising zone integrated into the structure of the ski. In fact, as the central part of the ski is thicker, it is possible to use less dense materials in order to lighten it and at the same time to obtain a stiffness equivalent to that of a ski with an attached platform.

In another embodiment, the inserts may be formed by elements made from a material that is more rigid than the materials that form the core of the ski in the region of the raising zone so as to increase the stiffness of the structure. In this case, the stiffness of the ski in the region of the underfoot zone is substantially increased by the characteristic inserts, without making the structure heavier than a ski equipped with an attached platform.

Advantageously, in practice, the inserts may be substantially parallel to the upper face of the raising zone.

In practice, the inserts may extend in the direction of the median longitudinal plane of the ski and not be present only in the vicinity of the lateral faces of the ski. In other words, the depth of these inserts may be optimized as a function of the overall stiffness it is desired to obtain for the ski. The two inserts may, for example, come into contact with one another in the region of the median longitudinal plane of the ski, over at least a part of their length.

In an advantageous form, the inserts are separated from the sole of the ski by a height greater than the minimum thickness of the ski, measured between the tip and heel zones. In other words, the characteristic inserts are preferably located in that portion of the ski that forms the zone for raising the binding.

In practice, these inserts influence the board, but they may also serve as a zone for anchoring the screws for fitting the binding, depending on their position within the structure.

The invention also relates to a process for manufacturing the ski described above. Thus, during this process, the various component elements of the ski are placed in a mold, between a mold base and a mold cover.

The process according to the invention is characterized in that:

- before molding, additional elements penetrating inside the mold are placed over the base of the mold, between the base and the cover and over each lateral face,
- after molding, the portion of the additional elements that protrude beyond the lateral faces of the raising zone is planed off.

In other words, the inserts are produced from pieces which are placed in the mold but which protrude beyond the final outline of the ski. These additional elements, and various layers located above, particularly the upper, protective layer, are then planed off in order to form the lateral faces of the ski, which makes it possible to obtain the final outline of the characteristic inserts, with their outer face being flush on the lateral face of the ski.

In a particular embodiment, a rigid element for incorporation in the raising zone may be placed over the additional elements. Just like the upper, protective layer, this rigid element may protrude laterally, for subsequent planing off during finishing operations.

In a particular embodiment, a reinforcement layer that protrudes beyond the base of the mold may also be placed over the additional elements, this reinforcement layer then being planed off with the additional elements forming the inserts.

This reinforcement layer may also be placed below the additional elements and be treated in the same manner.

BRIEF DESCRIPTION OF THE FIGURES

The invention and the advantages arising therefrom will become clearly apparent from the description or the embodiments that follow in support of the appended figures, in which:

FIG. 2 is a side view of the ski in FIG. 1;

FIGS. 3 and 4 are sectional views in planes III–III', IV–IV' in FIG. 2;

FIG. 5 is a sectional view similar to FIG. 3, showing a variant embodiment;

FIG. 6 is a sectional view in plane VI–VI' in FIG. 2;

IMPLEMENTATION OF THE INVENTION

As already mentioned, the invention relates both to an alpine ski having a zone for raising the binding, forming an integral part of the structure of the ski, and to a manufacturing process for obtaining such a ski.

Figure 1:
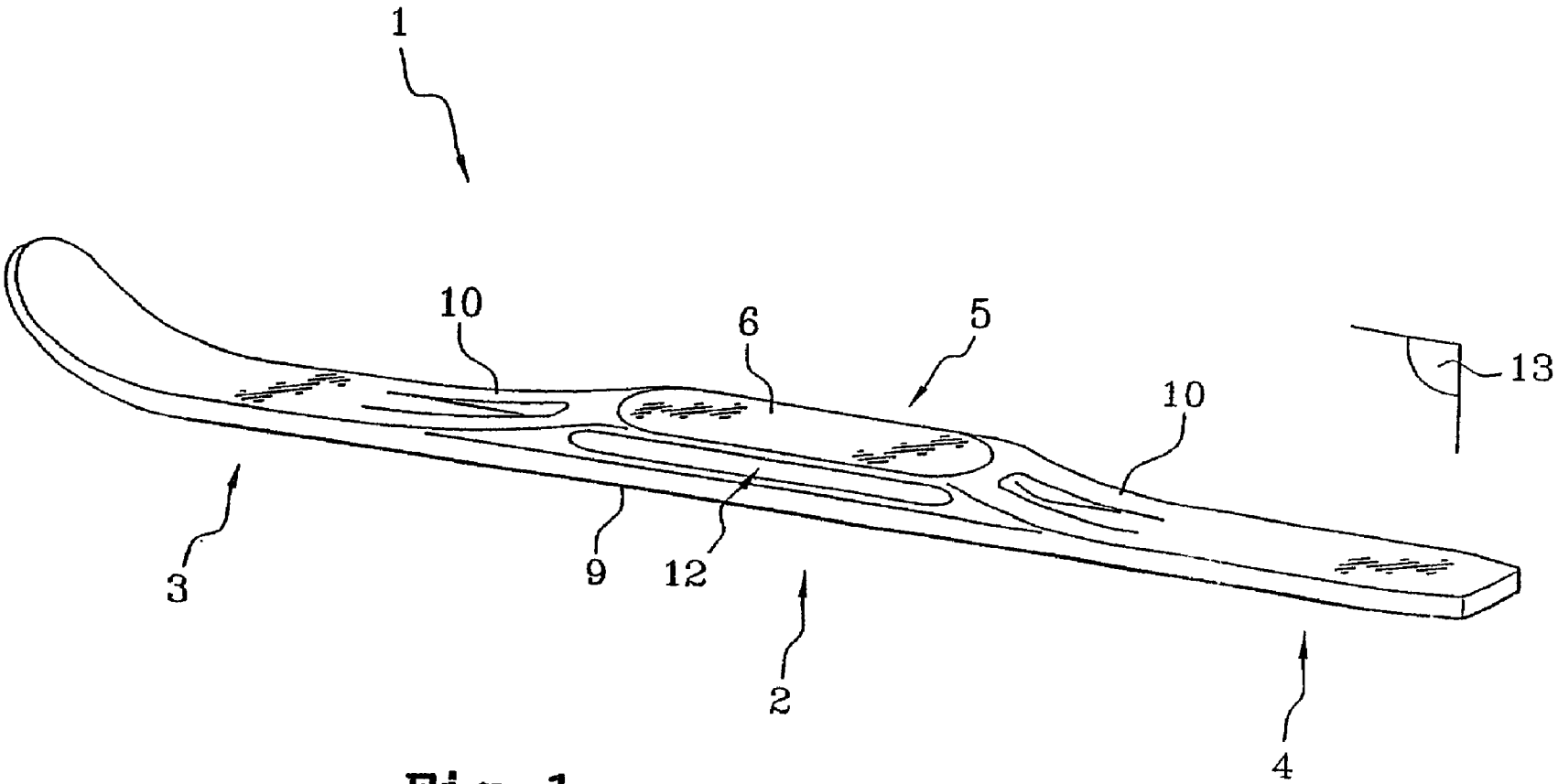
FIG. 1 is a basic perspective view of a ski according to the invention.

Such a ski (1) is illustrated in FIG. 1 and in a known manner has an underfoot zone (2), a tip zone (3) and a heel zone (4) In the region of the underfoot zone (2) , the ski (1) includes a zone, for raising the binding, that is formed by a protuberance of the actual structure of the ski. The upper face (6) of this raising zone (5) defines a thickening of the ski, relative to the edges (9), that is more accentuated in the underfoot area than in the heel zone (4) and in the tip zone (3). The upper face (6) of the raising zone (5) is for receiving the front stop and the heelpiece of the binding.

Accessorially, and as illustrated in FIG. 1, this raising zone (5) includes extensions (10) forming arms that extend forward and backward from the actual raising zone (5).

According to the invention, the ski (1) includes at least one insert (12) on each of its lateral faces (11). This insert (12) may, as illustrated in FIGS. 1 and 2, extend over practically all the length of the raising zone (5). This insert may also extend over just a part of this raising zone or, alternatively, extend over the entire length and emerge to the front and to the rear of the raising zone (5).

To simplify the diagrams, the customary protrusion of the edges, for making the edge stand proud in order to increase edge grip, has not been shown. In other words, in the figures, the lateral faces of the ski are substantially vertical, whereas, in reality, they are set back slightly above the edges.

According to a characteristic of the invention, the inserts (12) may be parallel to the upper face (6) of the raising zone (5). In that case they are parallel to the sole of the ski. These inserts (12) may be located at different height levels between the edges (9) and the upper face (6) of the raising zone (5). In the embodiment illustrated, the insert (12) is located at a height slightly greater than the thickness of the ski measured in the heel and tip zones. Nevertheless, these inserts could be located at a slightly lower level, closer to the edges (9).

According to a characteristic of the invention, as illustrated in FIG. 6, each insert (12) may include various zones having a different depth, measured in the direction of the median longitudinal plane of the ski (13). Thus, in its front (15, 16) and rear (19, 20) parts, the insert (12) has a depth smaller than half the width of the ski so that the structure of the ski forms lateral partitions (21, 22) connecting the upper part (27) of the raising zone (5) to the bottom part (28) of the structure of the ski. In the embodiment illustrated in FIGS. 2 and 6, these partitions (21, 22) are located substantially in line with the zones for receiving the front stop and the heelpiece of the binding, so as to ensure good transmission of bearing forces. Between these two partitions (21, 22), the inserts (12) come closer, in order to come into contact with one another, substantially in the central region of the raising zone.

In the embodiment illustrated in FIG. 6, the inserts have a depth which can vary in the direction of the length of the ski. Adjustment of this depth makes it possible to modify, as desired, the influence of the stiffness of the raising zone (5) on the rest of the structure of the ski. This influence is also modified in accordance with the nature of the material employed for producing the insert.

Thus, when this material is relatively compressible, slight transverse flexing of the board is promoted, in the region of the underfoot zone. This flexing is all the more substantial, the greater the depth of the inserts (12).

Conversely, when the material used is more rigid than the rest of the structure of the ski and, for example, produced from metal, the inset (12) tends to stiffen the raising zone of the ski, which promotes edge gripping. This use of rigid insert also makes it possible to lighten the structure of the ski in the central region and, overall, to reduce the weight of the ski.

The length of each of the inserts (12) may also be adjusted so as to optimize the dynamic behavior of the ski, while lightening its structure. The influence of the stiffness of the raising zone may also be adjusted by the choice of a profile or particular cross section in the case of the insert (12). Thus, in the embodiment illustrated in FIG. 5, the inserts (12) have an overall triangular cross section. The central portion of the structure forming the partition (30) has an overall trapezoidal cross section. This partition (30) thus has a smaller width in its upper part. This small width modifies the flexural stiffness of the upper part (31) of the raising zone (5), in order to permit a slight offset of the upper zone (31) about the longitudinal axis of the ski. This possibility of an offset is favored when the material used for the inserts (12) is compressible. Conversely, in the bottom part, the partition (30) is connected to the cross section of the bottom part (32)

of the structure of the ski. In this way, the bearing forces exerted on the upper face (33) of the raising zone (5) are effectively transmitted toward the edges, to promote edge gripping.

As illustrated in FIG. 5, the portion of the structure that is located between the inserts (12) may incorporate various types of supplementary element, which confers on it particular mechanical properties. Thus, with a view to lightening, an insert (34) made from a non-dense material, of the cellular or alveolar type, could be incorporated.

As the upper portion (31) of the raising zone (5) is intended to receive the front stop and the heelpiece, a reinforcement (37) allowing it to be stiffened could advantageously be incorporated therein, as illustrated in FIG. 5, notably when the inserts (12) are made from a compressible material. This reinforcement (37), arranged under the upper, protective face (38), may be drilled and receive the screws for fitting the elements that form the binding.

In an embodiment that is not shown, the ski may include two zones for raising the binding, a first one that receives the front stop and another that receives the heelpiece. In a particular embodiment, just one of the binding elements, for example the front stop, may be fitted on a zone for raising the binding, the other element, typically the heelpiece, being fitted on a conventional raising platform.

As already mentioned, the invention also relates to a process for manufacturing a ski according to the invention. As illustrated in FIGS. 7 to 12, this process may consist of the various stages which follow.

Figure 7:
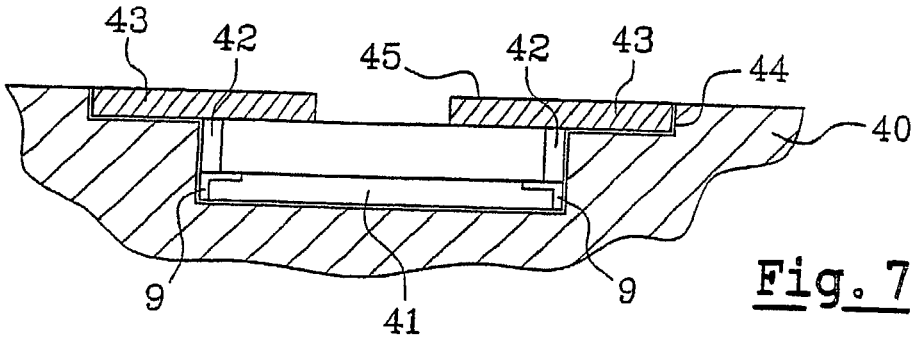
FIG. 7 a side cross-sectional view of elements of the ski being placed in a mold.
Figure 8:
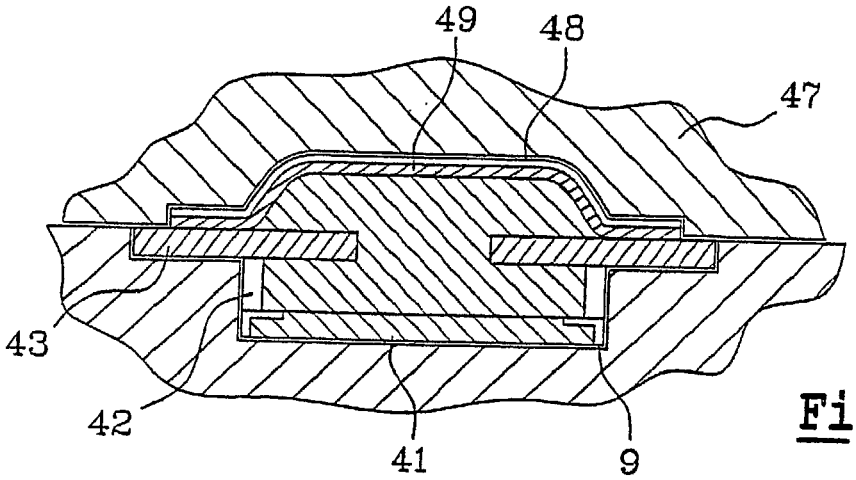
FIG. 8 is a side cross-sectional view of the mold of FIG. 7 with a mold covering being placed thereon.

Firstly, as illustrated in FIG. 7, the various elements for producing the bottom part of the structure of the ski are placed in a mold base (40). These elements are, in particular, the edges (9), the sole (41) and the lateral reinforcement elements (42) for forming the edges of the ski, at least in the bottom part of the latter. Next, two additional elements (43) are placed over the reinforcement elements (42). These additional elements will subsequently form the characteristic inserts, in the portion located within the structure of the ski. These additional elements (43) rest on a shoulder (44) produced in the base (40) of the mold. These additional elements (43) protrude inside the structure of the ski via a portion (45) which may extend reasonably deeply, depending on the depth it is desired to give to the characteristic inserts. The remainder of the structure for forming the ski has not been shown, since this may involve either preformed elements for forming the core, or various reinforcements that have no influence on the other characteristics of the invention. The ski may also be produced by injection of components reacting in situ, in order to form a polyurethane core.

In a second stage, after the characteristic additional elements (43) have been arranged, the mold cover (47) is placed in position after a sheet (48) for forming the upper, protective layer has been deposited. This sheet (48) may be combined with a reinforcement element (49) that is typically produced from glass fibers impregnated with epoxy resin and that will serve for anchoring the screws for fitting the elements of the binding.

Figure 9:
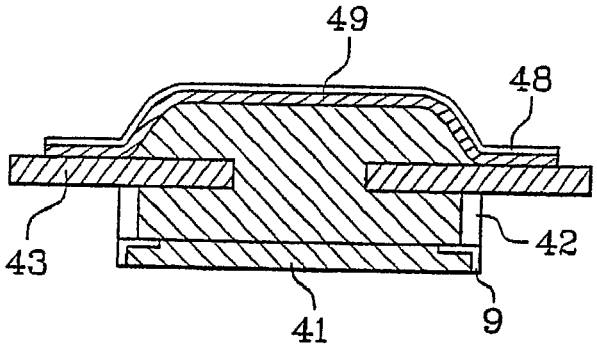
FIG. 9 is a side cross-sectional view of a molded ski after it has been removed from the mold of FIG. 7.
Figure 10:
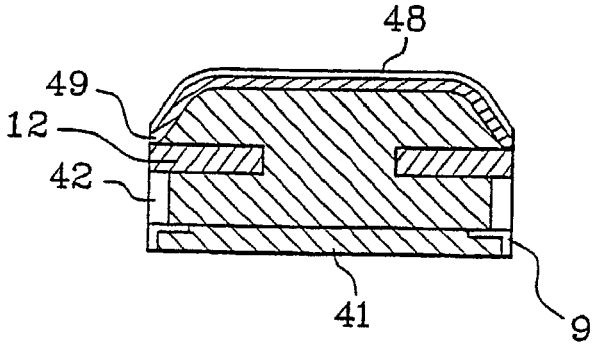
FIG. 10 is a side cross-sectional view of the ski of FIG. 9 with protuding elements removed.

After molding, irrespective of the type of process employed, the assembly thus produced is released from the mold and the figure illustrated in FIG. 9 is thus obtained. The additional elements (43) and also a part of the upper sheet (48) and of the reinforcement (49) protrude laterally beyond the final outline of the ski. The upper, protective layer (48), the reinforcement (49) and the additional elements (43) are then planed off laterally to the limits of the upper portion of the raising zone. The portions of the additional elements (43) that reside in the structure form the characteristic inserts (12), as illustrated in FIG. 10.

Figure 11:
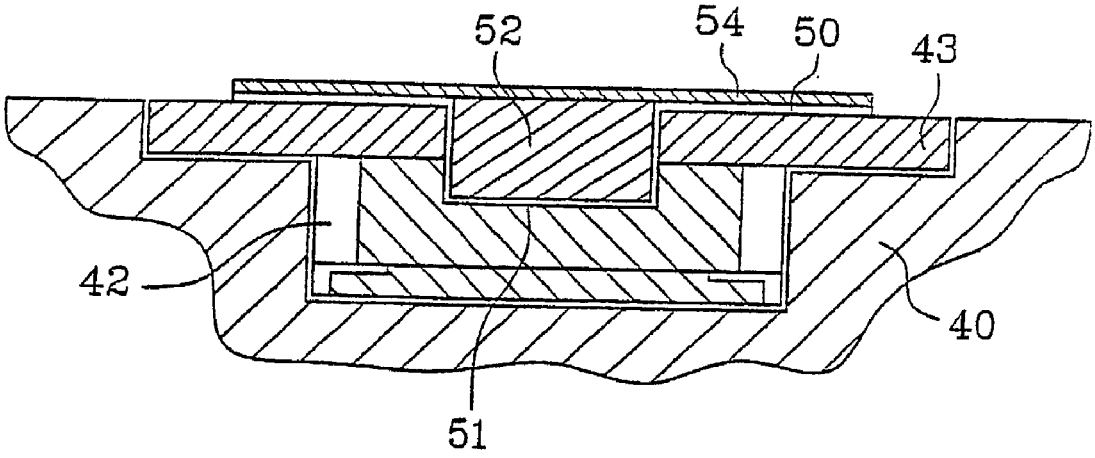
FIG. 11 is another embodiment of elements of a ski being placed in a mold.
Figure 12:
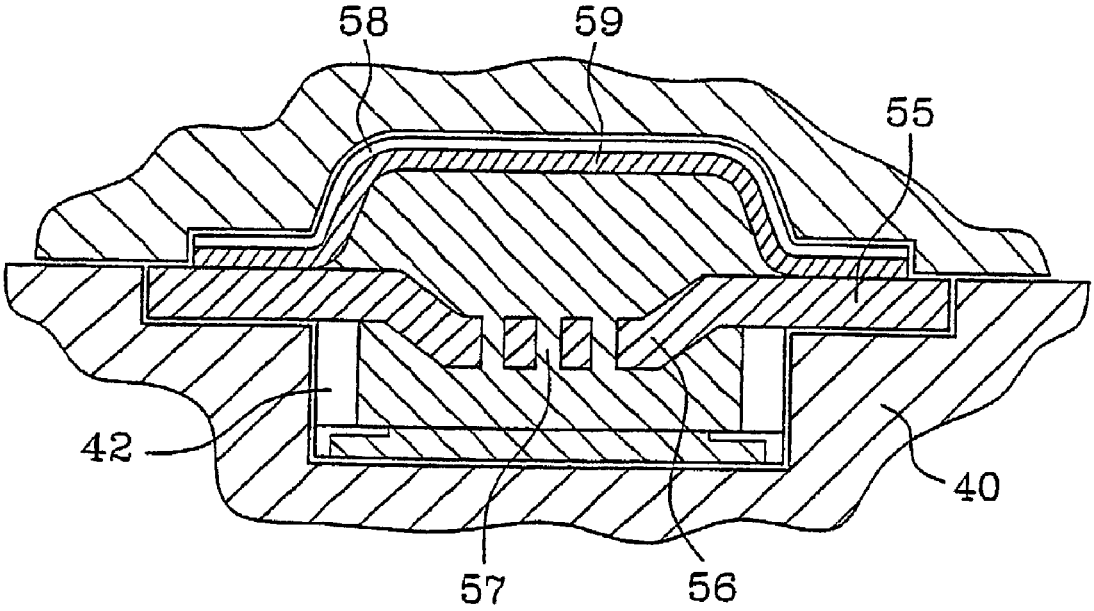
FIG. 12 is a side cross-sectional view of the mold of FIG. 11 having a mold cover placed thereon.

The process according to the invention may be implemented in accordance with other variants, as illustrated in FIGS. 11 and 12.

Thus, in a first variant of a ski with a rectangular cross section, illustrated in FIG. 11, the additional elements (43) are placed in the mold base (40) over the lateral reinforcement elements (42). A metallic sheet (50) that also protrudes laterally beyond the structure of the ski is placed over these additional elements (43). This sheet (50) is folded at its center in order to form a housing (51) that penetrates into the structure of the ski between the additional elements (43). This housing (51) receives a filling element (52) that will form the essential part of the partition connecting the upper part of the raising zone to the rest of the structure. This metallic sheet (50) will therefore be covered by a layer (54) of plastic material that will form the upper, protective layer. A fiber reinforcement element (not shown) may be added between the metallic sheet (50) and the protective layer (54).

After molding, the additional elements (43), the metallic sheet (50) and the protective layer (54) are therefore planed off in the region of the lateral reinforcement elements (52). The metallic layer (50) may advantageously be drilled in order to receive the screws for fitting the bindings.

In another variant embodiment, illustrated in FIG. 12, use is made of an additional piece (55) that is placed in the mold base (40) over the lateral reinforcement elements (42). This additional element may have, at its center, a depression (56) for balancing the upper and lower parts of the structure and facilitating the positioning of the various elements during placing in the mold. Apertures (57) are drilled in the bottom of this depression (56) to allow the passage of the polyurethane foam when the latter expands after injection of the liquid mixture of the reactive chemical components. When it expands, this foam presses the upper, protective layer (58) and the associated reinforcement (59) under the mold cover. After removal from the mold, the upper, protective layer (58) and the characteristic piece (55) are planed off in their portion that protrudes laterally beyond the final structure of the ski. The portions of the piece (55) that reside in the structure of the ski thus form the characteristic inserts, with the influence on the stiffness of the board that has already been mentioned.

The ski thus obtained therefore has a raising zone equipped with lateral inserts over all or part of its length. This raising zone may receive the various elements of the binding which are then screwed through its upper face. In certain cases in point, the screws for fitting the binding are anchored within the characteristic inserts, essentially in those cases in which the material used for the inserts has sufficient mechanical strength and, typically, when it is made from metal.

It emerges from the aforesaid that the ski according to the invention has multiple advantages and, in particular:

- the possibility of adjusting the overall stiffness of the ski, by virtue of the raising zone that forms part of the actual structure of the ski;
- the possibility of conferring damping properties on the underfoot zone by using inserts made from an elastomeric material of the viscoelastic type;
- the possibility of stiffening the structure of the ski in the region of the underfoot zone by means of rigid inserts, which makes it possible to use non-dense materials for the remainder of the structure of the ski in the region of the underfoot zone, and globally to lighten the ski.

The invention claimed is:

1. A ski (1) comprising at least one raising zone (5), for raising a binding, said at least one raising zone formed by a thickening of the structure of the ski thereby forming a protuberance in an underfoot zone (2) of the ski, wherein the at least one raising zone comprises an insert, an upper face, a plurality of lateral faces, and a plurality of edges, said insert (12) arranged over at least a fraction of the length of each lateral face of said plurality of lateral faces, said insert (12) being located between said upper face (6) of the at least one raising zone (5) and said plurality of edges (9), and wherein an outer face (14) of said insert (12) is flush on a lateral face (11) of said plurality of lateral faces of the ski;

a core having an upper portion and a lower portion, said upper portion extending into said at least one raising zone to said upper face and said lower portion extending below said at least one raising zone to a sole of the ski, said upper portion and said lower portion being two portions of a single molded piece; and wherein said insert is formed integral to said core, said insert being located between said upper portion and said lower portion and wherein an extent of said insert located closest to said sole is separated from said sole by a distance greater than a thickness of the ski in a tip zone and a heel zone of the ski.

2. The ski as claimed in claim 1, wherein the insert (12) is arranged parallel to the upper face (6) of the raising zone (5).

3. The ski as claimed in claim 1, wherein the insert is formed by elements made from a material that is less rigid than the materials that form the core of the ski in the region of the raising zone, so as to confer damping properties on the ski.

4. The ski as claimed in claim 1, wherein the insert is formed by elements made from a material that is more rigid than the materials that form the core of the ski in the region of the raising zone so as to increase the stiffness of the structure.

5. The ski as claimed in claim 1, wherein the insert extends in the direction of the median longitudinal plane (13) of the ski.

6. The ski of claim 1 wherein said insert comprises an upper side abutting said upper portion and said insert comprises a lower side abutting said lower portion.

* * * * *